United States Patent [19]

Hauschopp et al.

[11] 4,045,089

[45] Aug. 30, 1977

[54] APPARATUS FOR CONTROLLING THE POSITION OF A MINING MACHINE

[75] Inventors: Alois Hauschopp; Horst Schlüsener, both of Werne; Christoph Rassmann, Lunen, all of Germany

[73] Assignee: Gewerkschaft Eisenhutte Westfalia, Wethmar near Lunen, Germany

[21] Appl. No.: 708,368

[22] Filed: July 26, 1976

[30] Foreign Application Priority Data

July 31, 1975 Germany ..... 2534325

[51] Int. Cl.[2] ..... E21C 27/32

[52] U.S. Cl. ..... 299/43; 61/45 D

[58] Field of Search ..... 299/32, 34, 33, 43; 61/45 D

[56] References Cited

U.S. PATENT DOCUMENTS 3,357,742 12/1967 Dommann et al. ..... 299/32

3,874,734 4/1975 Plevak et al. ..... 299/32

3,915,500 10/1975 Schlusener ..... 299/32

*Primary Examiner*—Ernest R. Purser

*Attorney, Agent, or Firm*—Thompson, Birch, Gauthier & Samuels

[57] ABSTRACT

Apparatus is disclosed for controlling the position of a mineral mining machine such as a plough, movable along guide means such as a scraper-chain conveyor with a guide on one side. The apparatus employs piston and cylinder units coupled between the guide means and connecting devices pivoted to the guide means. A ball-and-socket joint is provided between each of the units and the associated connecting device.

Elongate beams are interconnected at one end and are mounted via a head piece and a swivel joint to each connecting device. These beams are pivoted and guided at their other ends on roof support structures so that the units can operate to tilt the guide means about the pivot axes between the connecting devices and the guide means to thereby control the position of the machine.

12 Claims, 7 Drawing Figures

APPARATUS FOR CONTROLLING THE POSITION OF A MINING MACHINE

BACKGROUND OF THE INVENTION

The present invention relates to mineral mining installations and more particularly to apparatus for controlling the position of a mineral mining machine movable along guide means.

One form of known apparatus, described in German patent specification No. 2,319,910 uses hydraulic piston and cylinder units connected between the guide means and elongate jib beams which are capable of pivoting in relation to the guide means and which are connected to roof support frames or structures.

In the construction described, the guide means takes the form of a scraper-chain conveyor having a guide for a machine in the form of a plough on its mineral-face side and the units are attached to the goaf side of the conveyor. The units can be extended or retracted to tilt the conveyor and hence the guide to thereby control the cutting level of the plough. There is a direct relationship between the working stroke or movement of the units and the angle of tilt thereby providing accurate control of the position of the plough. The conveyor and its guide are tilted about pivot axes between the beams and the conveyor and the beams extend by a sufficient distance outwardly from the conveyor to support the conveyor and the guide and inhibit any tendency to tilt due to the forces exerted by the plough. The beams can also serve to guide the floor sills of the support frames when these are shifted up to follow the working progress in known manner. Each adjusting unit is associated with two parallel beams which locate in guides of the associated support frame. As their forward ends, adjacent the conveyor, these beams are interconnected by a transverse yoke and the unit associated therewith is coupled to this yoke with a pivot pin with a horizontal axis. The yoke is itself pivotably connected to a coupling piece which defines the horizontal pivot axis between the conveyor and the beams and this coupling piece is in turn pivotably connected to the conveyor with a vertical pivot axis.

A general object of the present invention is to provide an improved form of apparatus.

SUMMARY OF THE INVENTION

In one aspect there is provided apparatus for controlling the position of a mineral mining machine movable along guide means; said apparatus comprising one or more beams connected with or connectible to a support structure and capable of pivoting, connecting means effecting pivotal connection between the guide means and the beam or beams and at least one piston and cylinder unit connected between the guide means and the connecting means and coupled to the latter with a ball-and-socket type joint wherein said unit is operable to adjust the guide means and hence control the position of the machine.

In another aspect there is provided apparatus for controlling the position of a mineral mining machine movable along guide means; said apparatus comprising beams pivotably connected to the guide means with connecting means and pivotably and displaceably connected with a support structure, at least one piston and cylinder unit operable to adjust the angle between the guide means and the beams, the unit being connected to the connecting means with a ball-and-socket type joint at a position disposed outwardly from the pivot axis between the guide means and the beams.

The guide means would normally be in the form of a scraper-chain conveyor having a guide or guides for a machine such as a plough. An apparatus made in accordance with the invention is able to provide sufficient freedom of movement for the key components while still providing sufficient stability and rigidity. This is especially but not solely in view of the ball-and-socket joint between the connecting means and the adjusting unit. Moreover the apparatus may be constructed in a space-saving manner so important in mine installations.

It is preferable also to provide a swivel joint between the connecting means and the beam or beams, which joint has a pivot axis extending substantially perpendicular to the main pivot axis between the guide means and the connecting means and providing the control function. This then enables relative rotory movement to occur between the beam or beams and the connecting means. The axis of the swivel joint, which may be constituted by a spigot and a bearing recess, may extend parallel to or at an angle to the axis of the or each beam. The angular arrangement is preferable where there are two beams which, in accordance with a further feature of the invention, converge in plan view towards the connecting means. The beams, which can be resilient round bars arranged in the same plane in side view, thus extend at an angle to the shifting direction of the associated support structure. The beams can extend through or above the floor sill of the associated support structure.

It is desirable to guide the rear ends of the beams, remote from the connecting means, on the support structure so that the beams can pivot and move longitudinally in relation to the support structure while being retained in relation to the latter. The connecting means itself can be formed from two detachable symmetrical parts, preferably castings or forgings of small dimensions, which define the socket part of the ball-and-socket joint as well as bores or coupling eyes for facilitating connection. The socket part of the joint can then embrace a ball part formed on the associated piston and cylinder unit.

A head piece may be used to couple the beams to the connecting means with the aforesaid swivel joint being therebetween. The actual pivot joint between the guide means and the connecting means may be formed by a pin extending through a boring in the connecting means and engaging in bearing recesses of a coupling plate attachable to the guide means. This coupling plate may also be a forging or casting of comparatively small dimensions and the bearing recesses can be simple open sided cavities making the plates simpler and cheaper to produce than would be the case with cylindrical bores.

The head piece used to couple the beams to the connecting means may be formed to take the beams above or more-or-less on a level with the connecting means and just above the floor. In the latter case, the beams can extend through spaces between plate sections of the floor sill of the associated support structure but where this is not possible the beams can be arranged above the floor sills. The head piece should be designed ideally to avoid obstructing the space between the guide means and the support structure while enabling the connecting means to be positioned as close to the floor as possible. The head piece may have bores forming connections for receiving the beams with the connecting means located generally between these connections. Preference is given to a system whereby the beams can be displaced in these connections for adjustment purposes and clamped in a desired position. To provide a traction-proof connection between the head piece and the connecting means alignable grooves can be provided in the components of the swivel joint, e.g. in the aforementioned spigot and bearing recess and a locking pin or the like can be inserted into these grooves. The amount of pivoting of the swivel joint can be determined by the length of these grooves.

The invention also provides apparatus for controlling the position of a mineral mining machine guided for movement on guide means; said apparatus comprising sets of elongate beams each supported at one end remote from the guide means, connecting devices each pivotably connected to the guide means and swivelably coupled to one of the sets of beams and piston and cylinder units connected with a ball and socket joint to one of the connecting devices and to the guide means and operable to tilt the guide means about the pivot axis between the associated connecting device and the guide means.

A mine installation employing apparatus in accordance with the invention may comprise a scraper-chain conveyor with a machine guide at one side; roof support structures arranged at the opposite side of the conveyor, a set of beams guidably connected with each support structure, connecting means for effecting pivotal connection between each set of beams and the conveyor and piston and cylinder units operable to adjust the position of the conveyor and the guide; the units being connected between the conveyor and the connecting means and coupled to the latter with ball-and-socket type joints.

The invention may be understood more readily, and various other features of the invention may become more apparent from consideration of the following description.

BRIEF DESCRIPTION OF DRAWINGS

Embodiments of the invention will now be described, by way of examples only with reference to the accompanying drawings, wherein.

DESCRIPTION OF PREFERRED EMBODIMENTS.

Figure 1:
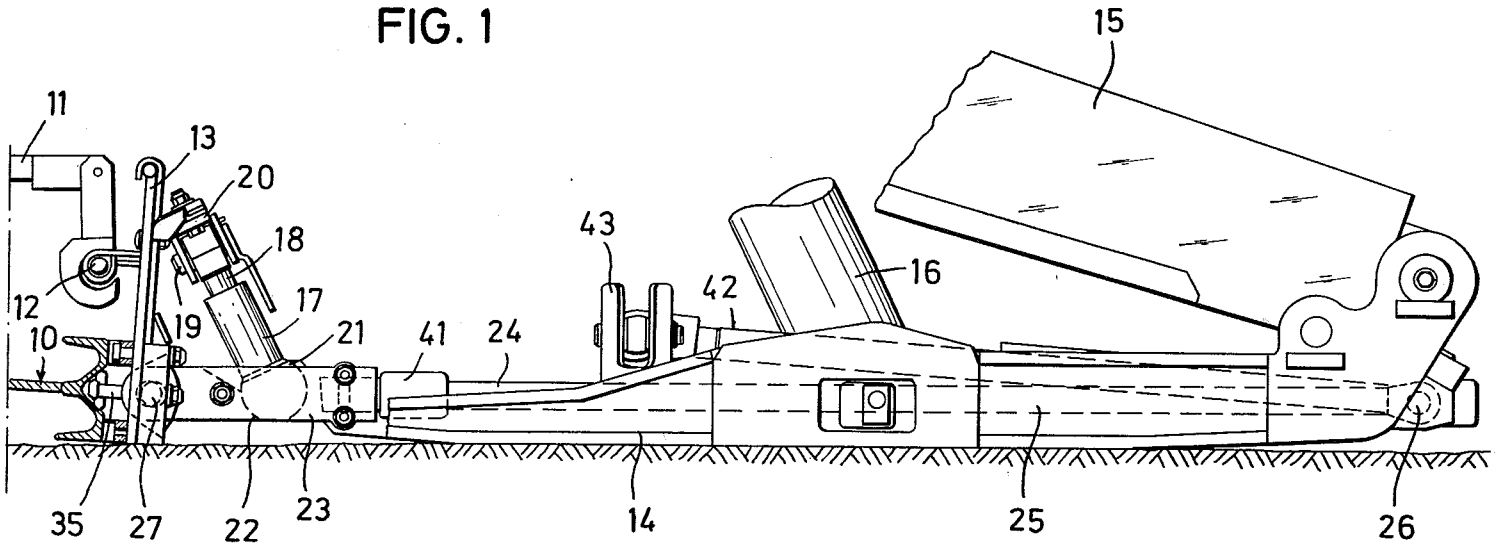
FIG. 1 is a schematic side view of a mineral mining installation employing apparatus made in accordance with the invention.
Figure 2:
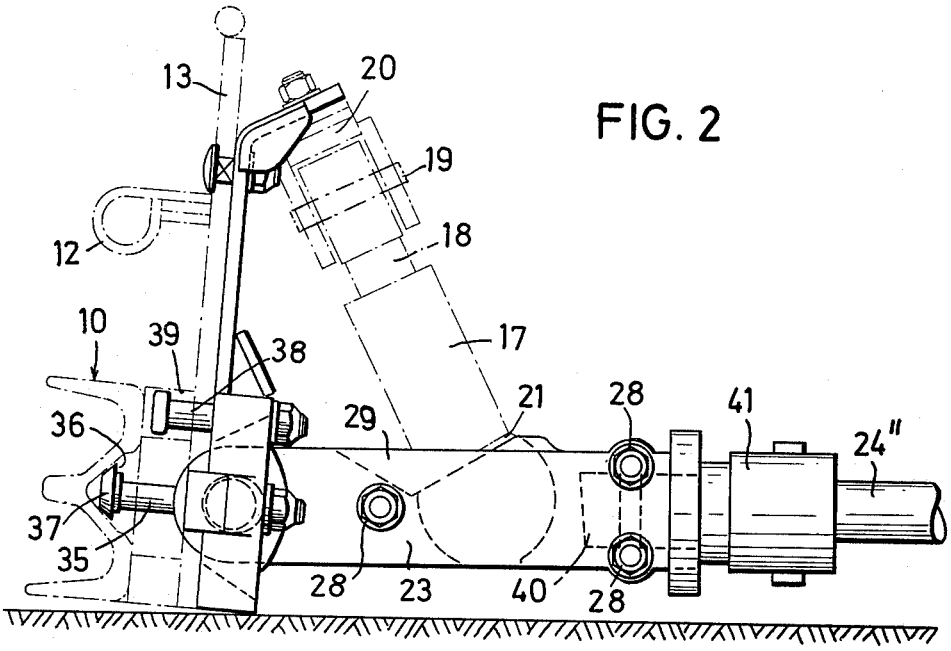
FIG. 2 is a schematic side view of part of the apparatus shown in FIG. 1 and taken on a somewhat enlarged scale.
Figure 3:
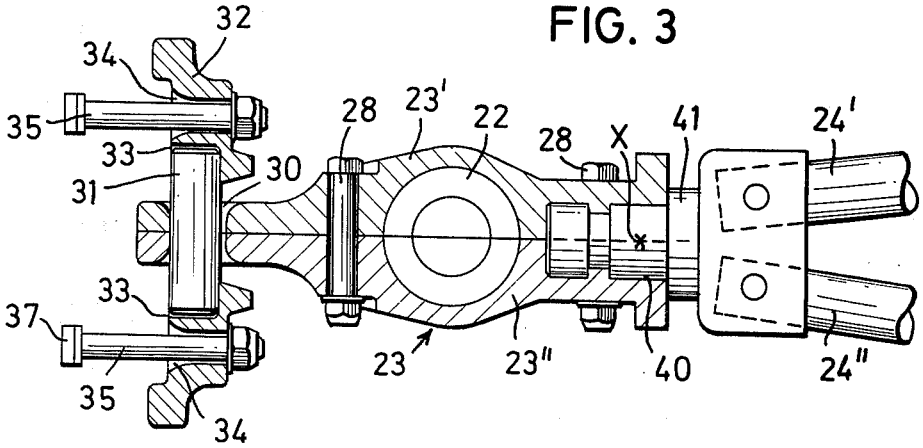
FIG. 3 is a sectional plan view of the part of the apparatus shown in FIG. 2.

Referring initially to FIGS. 1 to 3, a mine installation has a scraper-chain conveyor represented by chain-dotted lines 10 arranged alongside a mineral face. On the mineral face side of the conveyor there is a guide (not shown) which serves in known manner to guide a winning machine more usually a plough of the swordless type, which is moved back and forth along the conveyor 10. Preferably the guide for the plough has a ramp-like loading surface behind which guide channels for accommodating a chain used to drive the plough are located. These features are well known in the art. As shown also in FIG. 1, the plough has an arm 11 which extends over the conveyor 10 and engages on a further guide on the goaf side. This guide is in the form of rails 12 carried by barrier plates 13 fixed to the goaf side of the conveyor 10. The conveyor 10 and its guides form guide means for the plough.

On the goaf side of the conveyor 10, support or lining structures are provided to engage on the roof of the working as close as possible to the mineral face. The support structures are spaced apart along the working and each support structure has a floor sill 14 which may be a single or multi-part component, a fracture shield 15 articulated to the outermost region of the floor sill 14 and one or more hydraulic props 16. The or each prop 16 is connected to the floor sill 14 with the aid of a ball-and-socket type connection permitting universal movement and carries a roof cap (not shown) which is preferably pivotably connected to the shield 15. The prop or props 16 of each of the support structures can be raised to force its roof cap against the roof and thereby brace the structure while the shield 15 is raised to a protective position. These features are also known per se.

In accordance with the invention apparatus is provided to control the position of the machine or plough guided by the conveyor 10. In general, the control apparatus is shown to comprise piston and cylinder units 17 each of which has its piston rod 18 pivotably linked with a coupling to one of the barrier plates 13 with a pivot pin 19. Each unit 17 takes an inclined disposition and has a cylinder connected to or formed with a spherical head 21 which engages in a corresponding socket 22 of connecting means in the form of a multi-part connecting device 23. The resultant ball-and-socket connections 21, 22 permit the units 17 to swivel in all directions while resisting traction forces. The connecting devices 23 and head pieces 41 serve to connect the units 17 and the conveyor 10 to jib-like guide beams 24 which are preferably resiliently yieldable. The beams 24 are in turn guided by guide means such as rails 25 on the floor sills 14 of the support structures. Each support structure is thus provided with a pair of beams 24 linked to the conveyor 10 via one of the units 17 and its connecting device 23. Each pair of beams 24 is provided with guide pins 26 engaging in the guide rails 25. The pins 26 allow the beams 24 to pivot or move horizontally to a limited extent along the essentially horizontal guide rails 25, which may be U-shaped, while restraining vertical displacements. The beams 24 can locate between plate sections of the floor sill 14.

Preferably the rear ends of the beams 24 are provided with a transverse yoke or the like which pivotably supports a shifting ram 42 having its piston rod pivoted to a bracket 43 on the floor sill 14. The ram 42 can then lie between the beams 24 in a protected position beneath the fracture shield 15. The ram 42 does not therefore obstruct any of the other components of the installation.

Each connecting device 23 is connected with a pivot joint 27 to the conveyor 10 or an attachment thereof. The axes of the joints 27 are parallel to the longitudinal direction of the conveyor 10. The conveyor 10 and the machine or plough guide thereon can thus pivot about the axes of the joints 27 in relation to the beams 24. The beams 24 are restrained from vertical displacement at their rear ends by the pins 26 so that when the units 17 are extended or retracted, the conveyor 10 and the associated guide pivot about the joints 27 to raise or lower the guide and in this way the cutting action of the plough can be accurately controlled.

As shown more particularly in FIGS. 2 and 3, the connecting devices 23 each consist of symmetrical complementary parts or half shells 23', 23" separable along a vertical plane X. The parts 23', 23" are of identical shape and can be fabricated by drop forging or casting. The parts 23', 23" of the device 23 are secured together by means of nuts and bolts and the bolts 28 extend through aligned holes in the parts 23', 23". The bolts 28 lie on both sides of the socket 22 defined by shaped recesses in the parts 23', 23" and which, as shown in FIG. 2, surrounds more than half of the periphery of the ball head 21. In this way, the head 21 cannot be withdrawn from the socket 22 and the desired traction-resistant universal joint is established. As also shown in FIG. 2, the parts 23', 23" are also provided with further recesses 29 open to the upper surface of the device 23 to permit the cylinder of the associated unit 17 to move or cant when the head 21 swivels in the socket 22.

At their forward ends nearest the conveyor 10, the parts 23', 23" of the device 23 are apertured to form a bore or eye 30 for receiving a pivot pin 31 carried by a coupling plate 32. The eye 30 and pivot pin 31 constitute the pivot joint 27 (FIG. 1). The coupling plate 32 which can also be fabricated by forging or casting is provided with open recesses 33 receiving the ends of the pin 31 and bores 34 for receiving bolts 35 which serve to secure the plate 32 to the conveyor 10. The conveyor 10 may have holders (not shown) welded into the external V-shaped grooves 36 in the side walls of its channel sections or pans, which holders conventionally locate or receive screws or bolts used to secure the barrier plates 13 in known manner. In this case these holders can locate the heads 37 of the bolts 35 and hold these captive and the bolts 35 and their associated nuts can clamp the plates 32 and the barrier plates 13 to the conveyor goaf side wall. In addition each plate 32 has at least one further upper bore receiving another bolt 38 engaged in a bar 39 welded or otherwise fixed to the conveyor goaf side wall. When the barrier plates 13 and the plates 32 are assembled to the conveyor 10 the pins 31 defining the axis of movement about the joints 27 (FIG. 1) are held captive and are prevented from emerging from the recesses 33.

At their outermost ends remote from the conveyor 10 the parts 23', 23" are shaped to form a pivot bearing 40 receiving the spigot of a head piece 41 rotatable in the bearing 40 about an axis aligned with the plane X. As shown in FIG. 3, the spigot of the head piece 41 and the bearing 40 have a stepped profile with a central portion of reduced diameter. This provides a traction proof connection between the bearing 40 and the head piece 41 when the bolts 28 clamp the parts 23', 23" together while permitting the aforesaid rotation. The pivotability of the head piece 41 in relation to the connecting device 23 and the pivotability of the latter in relation to the conveyor 10 provides a cardanic type connection between the conveyor 10 and the beams 24. Round bars constituting the beams 24 (FIG. 1) are designated 24', 24" in FIGS. 2 and 3. The front ends of these bars 24', 24" are interconnected by the head piece 41 and converge towards the conveyor 10 in plan view so that their axes intersect on the plane X. The rear ends of the bars 24', 24" are guided and supported on the guide rails 25 of the support structure as mentioned previously.

Figure 5:
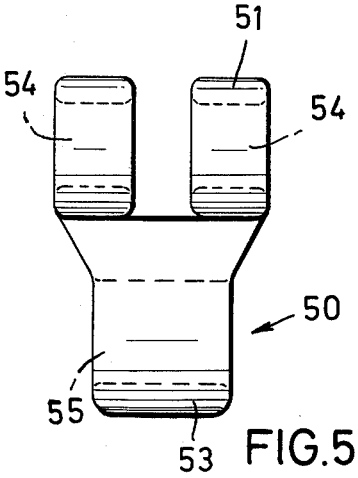
FIG. 5 is a side view of the head piece of the apparatus represented in FIG. 4.
Figure 6:
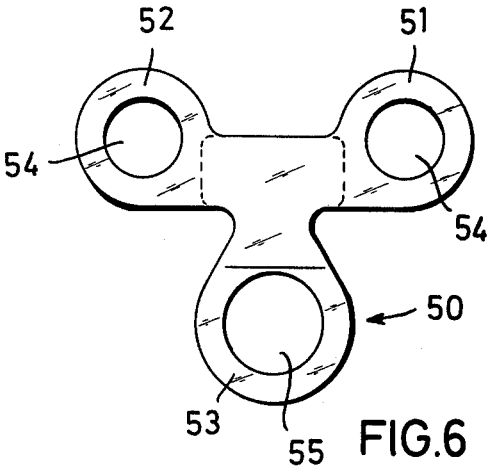
FIG. 6 is a plan view of the head piece shown in FIG. 5.
Figure 4:
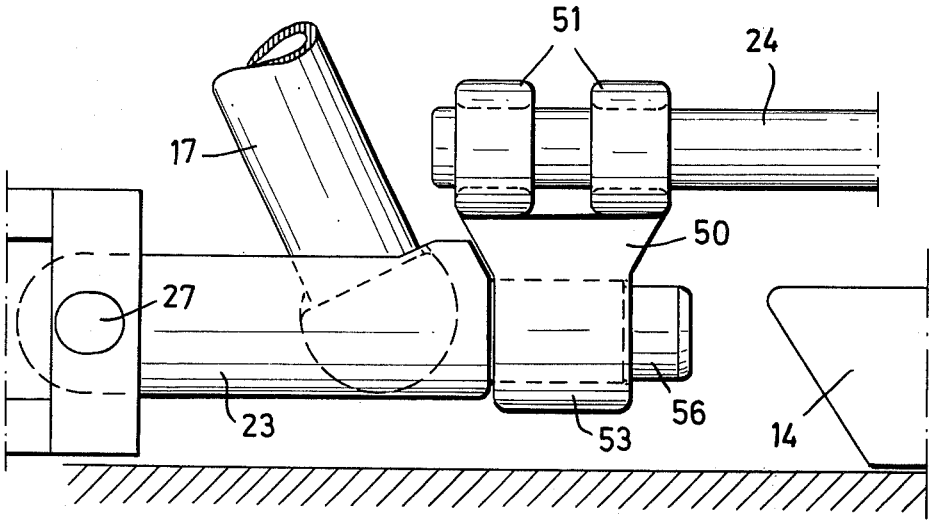
FIG. 4 is a schematic side view of part of a modified form of apparatus made in accordance with the invention.

In contrast to the apparatus shown in FIGS. 1 to 3, the beams 24 can be located above the floor sill 14 of the support structure and such a modified arrangement is depicted in FIG. 4. As shown in FIG. 4, the guide beams 24 are connected to the associated device 23 via a different type of head piece 50. As shown in FIGS. 4 to 6, this head piece 50 has bi-furcated lug-like upper connections 51, 52 with borings 54 for receiving the round bars constituting the beams 24. The head piece 50 also has a lower body 53 provided with a boring 55 for receiving a spigot 56 of the associated connecting device 23 or of an intermediate part connected therewith. Locking pins or spring cotters or some other similar fixing means can be used to secure the beams 24 to the connections 51, 52 while the spigot 56 is rotatable within the boring 55.

Figure 7:
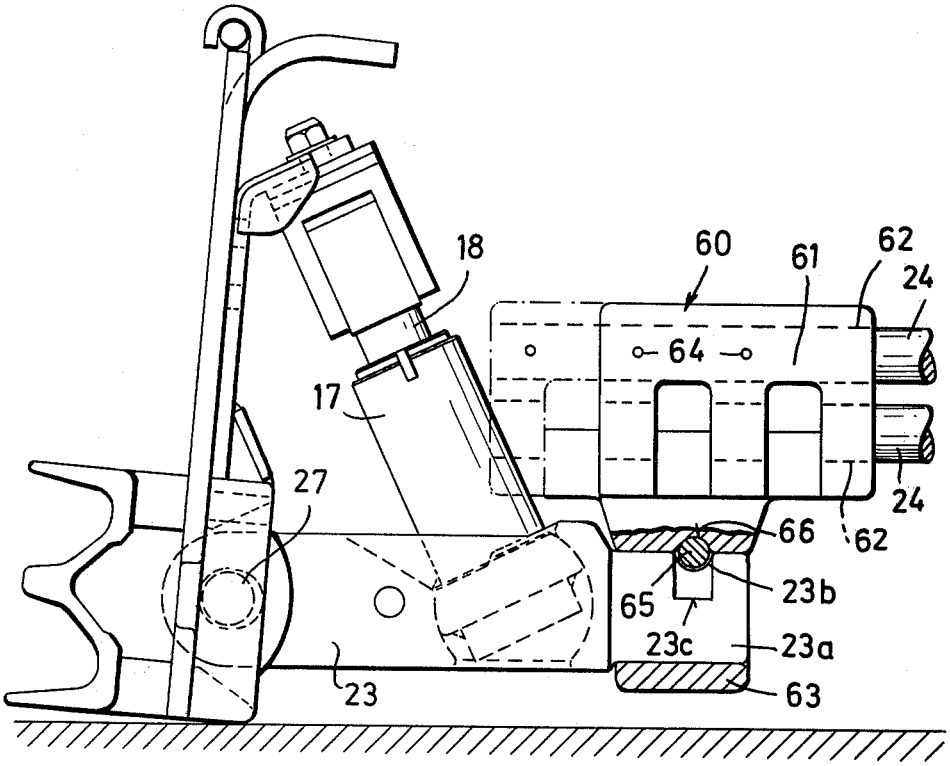
FIG. 7 is a schematic side view of another form of apparatus made in accordance with the invention.

FIG. 7 depicts another embodiment which employs a head piece 60 somewhat similar to the head piece 50 shown in FIGS. 4 to 6. This head piece 60 has a lower body 63 provided with a boring receiving a peg or spigot 23*a* of the associated connecting device 23. Above this body 63 there is an upper region 61 provided with bi-furcated portions defining four connections 62 with borings for receiving four guide beams or bars 24. Preferably the bars 24 can be inserted or withdrawn from the connections 62 while preserving the traction-proof coupling when assembled. This can be achieved by providing holes 64 in the upper region 61 which receive detachable locking elements insertable into or through the bars 24. The bars 24 may have several sets of bores permitting the bars 24 to be positionally adjusted in relation to the head piece 60. This is advantageous since it enables the roof caps of the support structures to be brought up as close as possible to the mineral face under different operating conditions.

The spigot 23*a* of the connecting device 23 which engages in the lower body 63 of the head piece 60 has a groove 23*b* with a substantially semi-circular cross-section extending around part of its periphery and terminating at 23*c*. The lower body 63 of the head piece 60 has a corresponding groove 66 formed in the wall of the boring receiving the spigot 23*a*. The grooves 23*b*, 66 can thus be aligned and a locking pin 65 is inserted into the thus-combined grooves 23*b*, 66 so as to connect the head piece 60 and the connecting device 23 in a traction proof manner. The connection nevertheless permits relative rotation to occur between the head piece 60 and the connecting device 23 about the axis of the spigot 23*a* and this motion is limited by the length of the grooves 23*b*, 66.

The connecting device 23 in the embodiments represented in FIGS. 4 to 6 and FIG. 7 can be formed from complementary parts as described in connection with the embodiment shown in FIGS. 1 to 3. Also the swivel connection 23*b*, 66, 65 may be adopted in the embodiments of FIGS. 1 to 3 and FIGS. 4 to 6 as can the provision for adjusting the position of the bars 24.

We claim:

1. Apparatus for controlling the position of a mineral mining machine movable along guide means; said apparatus comprising beams pivotably connected to the guide means with connecting means and pivotably and displaceably connected with a support structure, at least one piston and cylinder unit operable to adjust the angle between the guide means and the beams, the unit being connected to the connecting means with a ball-and-socket type joint at a position disposed outwardly from the pivot axis between the guide means and the beams with the unit in an inclined disposition.

2. Apparatus for controlling the position of a mineral mining machine guided for movement on guide means; said apparatus comprising sets of elongate beams each supported at one end remote from the guide means, connecting devices each pivotably connected to the guide means and swivelably coupled to one of the sets of beams and piston and cylinder units each connected with a ball-and-socket joint to one of the connecting device and to the guide means and being in an inclined disposition, each of the units being operable to tilt the guide means about the pivot axis between the associated connecting device and the guide means.

3. A mineral mining installation comprising a scraper-chain conveyor with a machine guide at one side; roof support structures arranged at the opposite of the conveyor, a set of beams guidably connected with each support structure, connecting means for effecting pivotal connection between each set of beams and the conveyor and piston and cylinder units operable to adjust the position of the conveyor and the guide; the units being connected between the conveyor and the connecting means in an inclined disposition and coupled to the connecting means with ball-and-socket type joints.

4. In an apparatus for controlling the position of a mining machine guided on guide means an comprising piston and cylinder units operably coupled between the guide means and a set of elongate beams connected to a roof support structure; an improved connection system comprising multipart devices each defining part of a ball-and-socket joint between the device and an associated piston and cylinder unit, means pivotably connecting said devices with the guide means and head pieces each interconnecting each set of beams and being pivotably connected to an associated device, the axis of pivoting between each device and the guide means being substantially perpendicular to the axis of pivoting between the device and its associated head piece with the ball and socket joint being located on the device between its pivotal connections with the guide means and the head piece.

5. Apparatus for controlling the position of a mineral mining machine movable along guide means; said apparatus comprising beams pivotably connected to the guide means with connecting means and pivotably and displaceably connected with a support structure, at least one piston and cylinder unit operable to adjust the angle between the guide means and the beams, the unit being connected to the connecting means with a ball-and-socket type joint at a position disposed outwardly from the pivot axis between the guide means and the beams, wherein the beams are connected to the connecting means with a swivel joint with a pivot axis extending substantially perpendicularly to a further pivot axis between the connecting means and the guide means.

6. Apparatus for controlling the position of a mineral mining machine movable along guide means; said apparatus comprising beams pivotably connected to the guide means with connecting means and pivotably and displaceably connected with a support structure, at least one piston and cylinder unit operable to adjust the angle between the guide means and the beams, the unit being connected to the connecting means with a ball-and-socket type joint at a position disposed outwardly from the pivot axis between the guide means and the beams, wherein the ends of the beams nearest the connecting means are connected to a head piece rotatably mounted to the connecting means.

7. Apparatus according to claim 6, wherein the swivel joint is composed of a spigot engaging in a bearing recess.

8. Apparatus according to claim 7, wherein the spigot and bearing recess have alignable grooves which can receive a detachable locking element for securing the head piece to the connecting means while permitting relative rotation therebetween.

9. Apparatus according to claim 6, wherein the head piece has bores receiving the beams and the beams can be adjusted by sliding in the bores and wherein detachable fixing means serves to clamp the beams to the head piece.

10. Apparatus according to claim 9, wherein the beams engage in the head piece above the connecting means.

11. Apparatus according to claim 9, wherein the beams engage in the head piece generally level with the connecting means.

12. Apparatus for controlling the position of a mineral mining machine movable along guide means; said apparatus comprising beams pivotably connected to the guide means with connecting means and pivotably and displaceably connected with a support structure, at least one piston and cylinder unit operable to adjust the angle between the guide means and the beams, the unit being connected to the connecting means with a ball-and-socket type joint at a position disposed outwardly from the pivot axis between the guide means and the beams, wherein the connecting means comprises two detachably interconnecting complementary parts collectively defining the socket part of the ball-and-socket joint and wherein the parts of the connecting means have bores receiving a pivot pin, defining the pivot axis and between the connecting means and the guide means, and located within recesses of a coupling plate detachably secured to the guide means.

* * * * *